US005342484A

United States Patent [19]

Cutright et al.

[11] Patent Number: 5,342,484

[45] Date of Patent: Aug. 30, 1994

[54] METHOD AND APPARATUS FOR MAKING BANDED SMOKING ARTICLE WRAPPERS

[75] Inventors: Edwin L. Cutright, Powhatan; G. Robert Scott, Midlothian; Howard W. Vogt, Providence Forge, all of Va.

[73] Assignee: Philip Morris Incorporated, New York, N.Y.

[21] Appl. No.: 31,946

[22] Filed: Mar. 16, 1993

[51] Int. Cl.[5] ..... D21H 15/00

[52] U.S. Cl. ..... 162/139; 162/109; 118/213; 118/301; 427/350; 427/280; 427/282

[58] Field of Search ..... 118/406, 213, 301, 313, 118/324, 315, 211-212; 162/109, 135, 139; 427/350, 288, 382, 210, 286, 424; 131/365

[56] References Cited

U.S. PATENT DOCUMENTS

| | | | |
|---|---|---|---|
| 2,728,685 | 12/1955 | Muench | 117/25 |
| 2,792,780 | 5/1957 | Jacob | 101/119 |
| 3,102,046 | 8/1963 | Bushey | 117/38 |
| 3,108,560 | 10/1963 | Bowne | 113/95 |
| 3,143,065 | 8/1964 | Warczak | 101/147 |
| 4,166,368 | 9/1979 | Beninca et al. | 68/20 |
| 4,209,553 | 6/1980 | Greenberg | 427/179 |
| 4,562,099 | 12/1985 | Hinchcliffe | 427/282 |
| 4,604,966 | 8/1986 | Kohn | 118/406 |
| 4,680,199 | 7/1987 | Vontell et al. | 427/199 |
| 5,196,063 | 3/1993 | Ludwig | 118/213 |

FOREIGN PATENT DOCUMENTS

| | | | |
|---|---|---|---|
| 3309975 | 9/1984 | Fed. Rep. of Germany | 118/301 |
| 8002852 | 12/1980 | PCT Int'l Appl. | 118/301 |

*Primary Examiner*—W. Gary Jones
*Assistant Examiner*—Brenda Adele Lamb
*Attorney, Agent, or Firm*—Kevin B. Osborne; James E. Schardt; Charles E. B. Glenn

[57] ABSTRACT

A method and apparatus for making banded smoking article wrappers is provided. The apparatus includes a cylindrical rotating applicator that has alternating regions of mesh material and regions of solid material on its outside surface. The applicator allows repetitive patterns of additional slurry to be applied to a continuous web of paper so that the basis weight of the paper is repetitively increased. Such paper, when incorporated into a smoking article, modifies the burn rate characteristics of the article.

37 Claims, 4 Drawing Sheets

METHOD AND APPARATUS FOR MAKING BANDED SMOKING ARTICLE WRAPPERS

BACKGROUND OF THE INVENTION

This invention relates to a method and apparatus for making banded smoking article wrappers. More particularly, the invention relates to a method and apparatus for applying cellulosic slurry in repetitive patterns to paper for making banded smoking article wrappers.

Smoking article manufacturers have long appreciated the usefulness of adding flavorings or burn control additives to smoking article paper. More recently, it has been recognized that smoking article paper could be altered so that smoking articles incorporating the altered paper will have a reduced burn rate when the smoking article is not drawn on by a smoker.

Paper smoking article wrappers have burn characteristics, including burn rates and static burn capabilities. It is known that burn characteristics can be modified by adding fillers, coatings, or other additives to papers. Copending, commonly-assigned U.S. Pat. application Ser. No. 07/614,620, filed Nov. 16, 1990, which is hereby incorporated by reference in its entirety, includes a description of many of these methods, and also discloses a nonlaminated paper of variable basis weight having modified burn rate characteristics. The methods and apparatus disclosed in that application, however, are not the only solutions for making banded smoking article wrappers with modified burn rate characteristics.

It would be desirable to provide a method and apparatus for making banded smoking article wrappers with modified burn rate characteristics.

It would also be desirable to provide a method and apparatus for efficiently making such wrappers.

SUMMARY OF THE INVENTION

Accordingly, it is an object of the present invention to provide a method and apparatus for making banded smoking article wrappers with modified burn rate characteristics.

It is also an object of the present invention to provide a method and apparatus for efficiently making such wrappers.

In accordance with the invention there is provided a method of applying a fluidized material (e.g., a cellulosic slurry) to a substrate (e.g., a continuous web of smoking article wrapper paper). The method includes the steps of: (a) moving the substrate along a path; (b) providing a cylindrical surface having alternating regions of mesh material separated by regions of solid material; (c) applying the fluidized material to the cylindrical surface; (d) providing a vacuum on an underside of the mesh material so as to allow the fluidized material to adhere to the alternating regions of mesh material; (e) rotating said cylindrical surface so that the adhered fluidized material is positioned adjacent the substrate; and (f) providing pressure on the underside of the mesh material to release the adhered fluidized material from the mesh material, wherein the released fluidized material attaches to the substrate. The substrate can then be formed in smoking article wrappers having repetitive regions of increased basis weight which modify the burn rate characteristics of a smoking article. There is also provided an apparatus for making banded smoking article wrappers.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

The present invention relates to a method and apparatus for modifying the characteristics of paper by applying repetitive patterns of fluidized material to the paper. More particularly, the present invention relates to a method and apparatus for modifying the basis weight of smoking article paper in select regions so that the burn rate characteristics are modified in those regions.

An increase in basis weight of localized regions in a paper web may be achieved by increasing either the thickness, the density, or both in those regions. The increase in basis weight may be accomplished by depositing, onto an existing pulp web in a papermaking machine, additional fluidized material (e.g., cellulosic pulp), or a filler material, or combinations thereof. As used herein, "fluidized material" means a substantially solid material either suspended or dissolved in a liquid to form a material that substantially has the properties of a fluid.

The modified regions of the paper made in accordance with this invention have a basis weight above that of the underlying base web. When paper made with the present invention is incorporated in a smoking article, the smoking article will have modified burn rate characteristics. For example, the static burn rate of the smoking article may be substantially decreased during combustion of the modified regions, because regions of increased basis weight have decreased porosity. The rate of oxygen diffusion through the paper in these regions is thereby decreased, retarding combustion of the smoking article.

The dimensions of the modified regions may also affect the burn characteristics of the paper and, consequently, a smoking article incorporating the paper. When the paper is incorporated in a smoking article, the modified regions form a series of rings of known width and separation along the longitudinal axis of the smoking article. Both the width of, and the amount of separation between, these rings of modified paper have a substantial effect on the overall burn rate of the smoking article. The width and amount of separation of the rings effectively determines what percentage of the smoking article will experience a burn rate decreased from the nominal rate associated with the base web.

Figure 1:
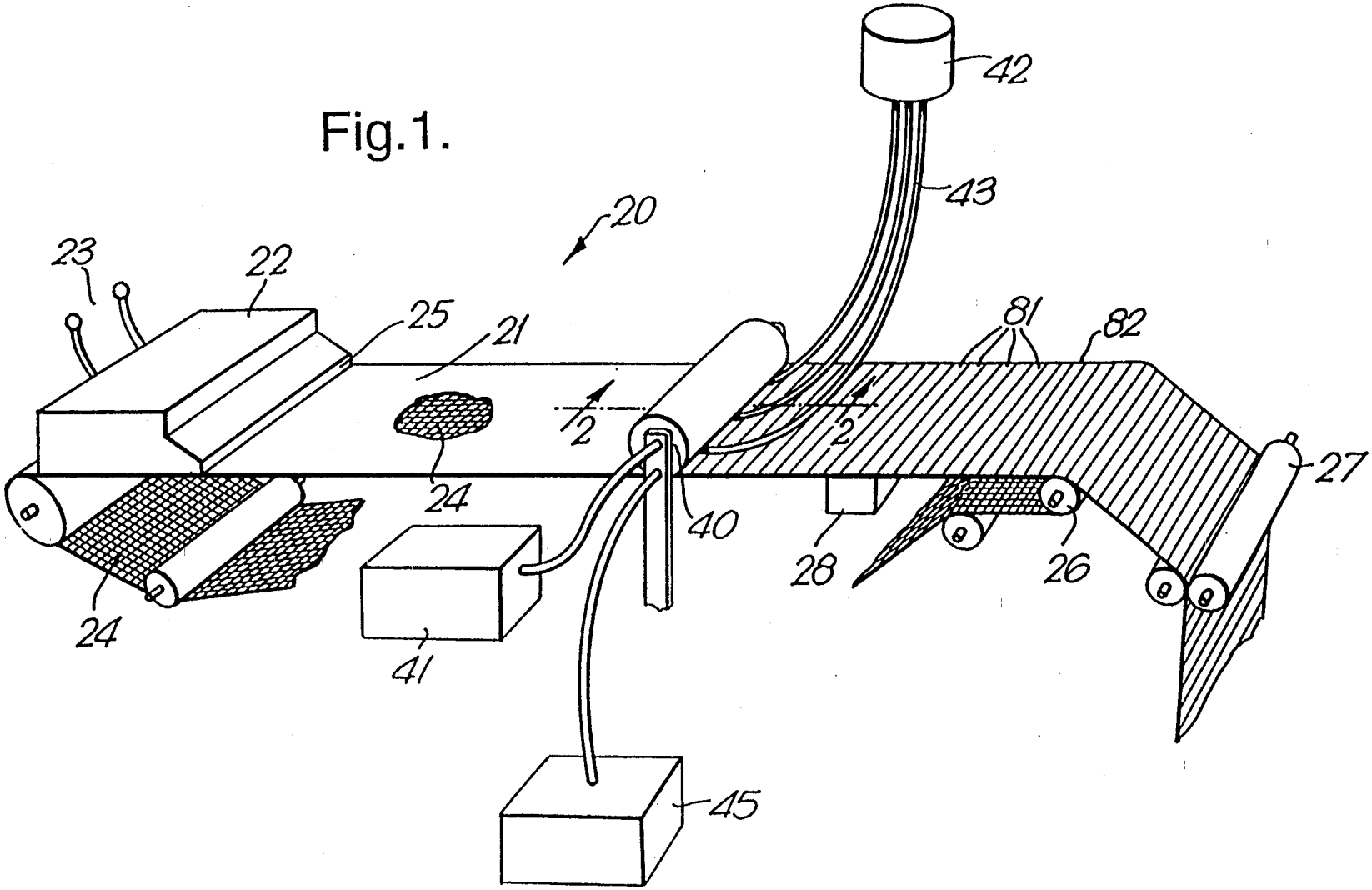
FIG. 1 is a perspective view of a first preferred embodiment of the present invention.

A first preferred embodiment of the apparatus of this invention is shown in FIG. 1, which depicts the pulp web-forming area of a conventional Fourdrinier papermaking machine modified in accordance with the present invention to produce banded smoking article wrappers. Applicator 40 is used to apply repetitive patterns of fluidized material, e.g., a slurry of cellulosic pulp, to pulp web 21 so as to repetitively increase the basis weight of the pulp web to provide banded smoking article wrapper paper.

Headbox 22 contains a quantity of cellulosic pulp which is used to form pulp web 21. Pulp is supplied to headbox 22 by plurality of conduits 23 which communicate with a pulp source, such as a pulp storage tank (not shown). Immediately below headbox 22 is an endless forming wire 24. A slice 25 defined in a lower portion of headbox 22 adjacent to wire 24 permits the pulp from the headbox 22 to flow through slice 25 onto the top surface of the wire 24 to form pulp web 21. Slice 25 is usually narrow in height in order to regulate the amount of pulp which flows from headbox 22. Slice 25 typically may extend substantially across the entire width of pulp web 21.

The top portion of wire 24 is adapted to move forwardly toward couch roll 26 and away from slice 25. The direction from headbox 22 toward couch roll 26 is defined as the downstream direction. Once pulp web 21 has been formed, it passes under applicator 40 which deposits fluidized material onto pulp web 21.

Referring to FIGS. 2–5, applicator 40 includes slurry coater 46 and screen roller 60 which rotates around fixed valve 62. Fixed valve 62 includes pressure port 52, vacuum port 54 and cleaning injection port 56. Applicator 40 works as follows.

Slurry is applied to surface 51 of screen roller 60 using slurry coater 46. Surface 51 of screen roller 60 includes alternating regions of screen sections 64 separated by spacers 66 (see FIGS. 4 and 5). Vacuum port 54, connected to vacuum 45 (FIG. 1), is used to hold the coated slurry only on screen sections 64 and not on spacers 66. Because screen sections 64 become coated with slurry, while spacers 66 do not, a repetitive pattern of slurry is formed on surface 51 of screen roller 60 in region 51A adjacent vacuum port 54. This pattern is applied to pulp web 21 in region 51B so as to form bands of increased basis weight.

Figure 4:
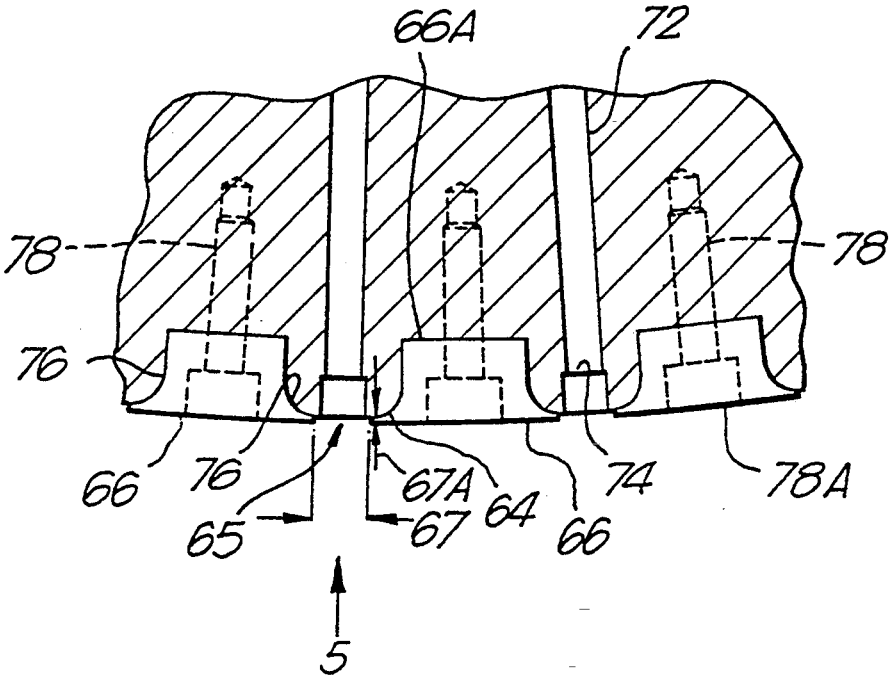
FIG. 4 is an enlarged view of area A of FIG. 2.

Slurry coater 46 includes slurry supply 47, doctor blade 48 and slurry return 49. Slurry supply 47, connected to slurry reservoir 42 (FIG. 1), applies a continuous thin layer of slurry to surface 51 of screen roller 60. Slurry adheres to surface 51 of screen roller 60 with the aid of vacuum port 54 which pulls the slurry towards screen sections 64 (FIG. 4). Screen sections 64 are preferably made from the same type of screen material used in conventional paper making (e.g., wire 24 in FIG. 1), so as to allow slurry to adhere to surface 51 by way of the vacuum force provided by vacuum port 54. Thus, screen sections 64 preferably have a mesh size of approximately 100, with openings of approximately 5.9 mils by 5.9 mils.

Screen sections 64, in conjunction with spacers 66 (FIG. 4), define a recess 65 which contain the slurry that is eventually transferred to pulp web 21 upon further rotation of screen roller 60. Doctor blade 48 of slurry coater 46 assists in removing excess slurry from surface 51 of screen roller 60 so that the slurry is confined to recesses 65 of rotating screen 60 so as to not cover spacers 66. Slurry return 49 of slurry coater 46 recovers excess slurry removed from rotating screen 60.

In accordance with the present invention, the spacing 67 between adjacent spacers 66 determines the width of recesses 65 and, therefore, the width of the "band" of slurry applied to pulp web 21. The thickness 67A associated with spacers 66 determines the thickness of the "band" of slurry applied to pulp web 21. Width 66A of spacers 66 determines the spacing between bands.

Preferably, spacing 67 ranges from 2 to 8 mm, thickness 67A ranges from about 0.01 to 0.03 inch, and width 66A ranges from about 12 to 20 mm. More preferably, spacing 67 is about 5 mm, thickness 67A is about 0.015 inch and width 66A is about 16 mm. Of course, many other dimensions are possible by replacing spacers 66 with spacers of different dimensions or by altering the number of recesses 65 per circumference of applicator 40.

As screen roller 60 rotates, slurry which adheres to screen sections 64 in region 51A, moves into region 51B adjacent pressure port 52. At this point the slurry releases from screen sections 64 and attaches to web 21 because pressure port 52 forces the slurry to disengage from screen sections 64.

As screen roller 60 continues to rotate from region 51B to region 51C, surface 51 encounters region 51C adjacent cleaning injector 56 where a mixture of air and water is injected radially outward through screen sections 64 in order to clean it. Vacuum cleaning port 58 is used to assist in the cleaning process by pulling the air and water mixture through screen 67 into vacuum cleaning port 58.

Figure 3:
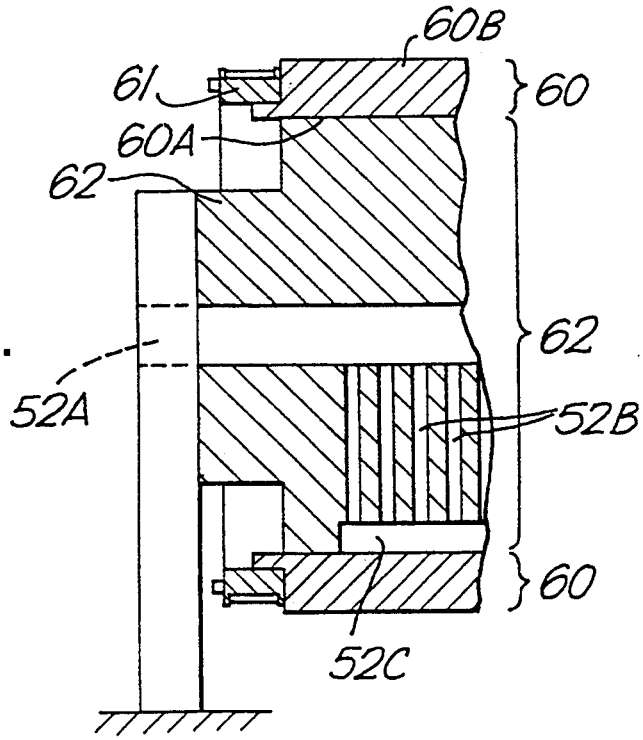
FIG. 3 is a fragmentary cross-sectional view of the applicator of the present invention, taken along line 3—3 of FIG. 2.

Referring particularly to FIG. 3, screen roller 60 rotates around fixed valve 62 by way of drive 61 positioned on one or both ends of screen roller 60. Drive 61 causes screen roller 60 to rotate at a speed substantially synchronized with moving web 21. Under these preferred drive conditions, the spacing between the bands of slurry applied to web 21 will be determined by spacing 67 (FIG. 3) on screen roller 60. Preferably, applicator 40 is spaced above pulp web 21 so that spacers 66 do not make substantial contact with pulp web 21.

Figure 2:
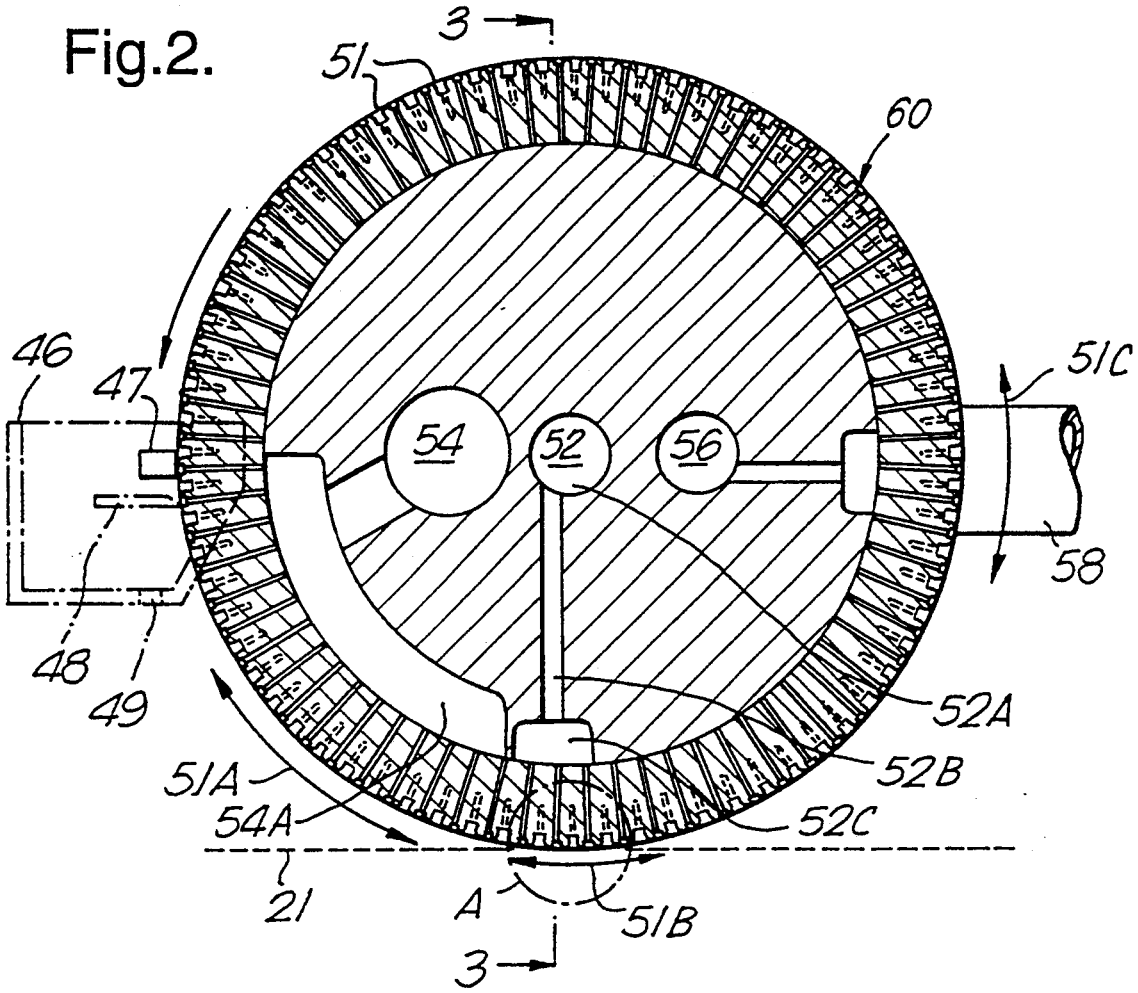
FIG. 2 is a cross-sectional view of the applicator of the present invention, taken along line 2—2 of FIG. 1.

As shown in FIGS. 2 and 3, pressure port 52 includes pressure supply region 52A, plurality of radial channels 52B and pressure slot 52C. In accordance with the present invention, air is supplied to pressure supply region 52A at the center of fixed valve 62 by way of air compressor 41 (FIG. 1). If desired, any other means which can supply air at a pressure above 1 atmosphere can also be used. Radial channels 52B provide air flow communication between pressure supply region 52A and pressure slot 52C. Pressure slot 52C is shaped to allow the slurry to release from screen sections 64 when a slurry-coated rotating screen 60 rotates into position 51B.

In the alternative, other substances besides air could be used with pressure port 52 to assist in forcing the slurry to release from screen sections 64 when rotating screen 60 rotates from position 51A into position 51B.

Although radial channels 52B are shown in FIG. 2 as forming approximately a 90° angle with the underlying pulp web 21, it is apparent that this angle can be changed by rotating fixed valve 62 relative to screen roller 60. This feature of the present invention can be used to accurately adjust the deposit point of slurry onto the underlying pulp web.

Figure 5:
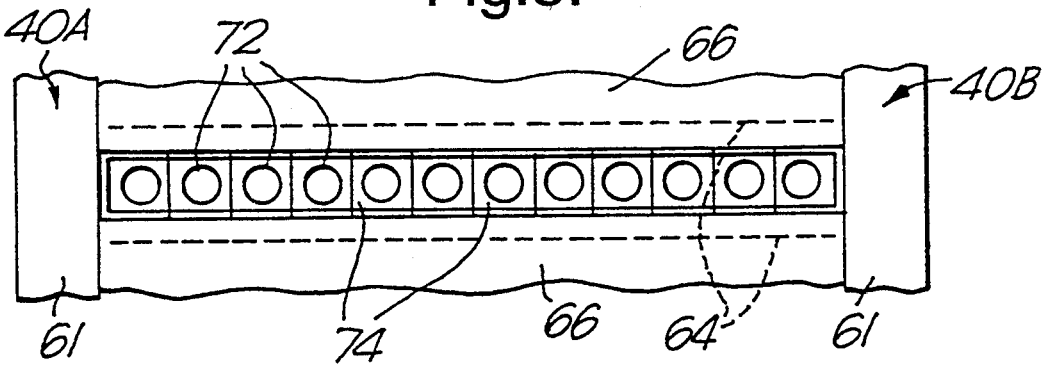
FIG. 5 is a fragmentary view of the applicator of the present invention, taken along line 5—5 of FIG. 4.

As shown in FIGS. 4 and 5, rotating screen 60 includes closely-pitched radial holes 72 and continuous slots 74 which provides air flow communication between inside surface 60A of screen roller 60 (FIG. 3)

and screen sections 64. Continuous slots 74 are individually covered with screen sections 76.

Spacers 66, which run from end 40A to end 40B of applicator 40, hold down screen sections 76 and are removably attached to rotating screen 60 by way of screws 78. Screw heads 78A are preferably filled with a potting material (not shown) in order to provide a surface which is substantially flat and flush with surfaces 79 of spacers 66. Individual spacers 66 are removable from applicator 40, by way of screws 78, so as to allow individual screen sections 76 to be conveniently replaced. In the alternative, spacers 66 could be held in place by way of screws (not shown) which attach to the inside surface 66A of spacers 66 through holes provided from inside surface 60B (see FIG. 3) of screen roller 60 instead of outside surface 60A.

Referring back to FIG. 1, repeated rotation of screen roller 60 causes a series of bands 81 to be applied to pulp web 21. These bands are substantially rectangular, corresponding to the shape of recesses 65 (FIGS. 4 and 5) of applicator 40. These bands 81 preferably are substantially parallel to one another and equally spaced and form application pattern 82 which alters the characteristics of the pulp web 21.

After applicator 40 has applied application pattern 82 to pulp web 21, the web continues to move in a downstream direction. As wire 24 begins to move downwardly about couch roll 26 and back toward headbox 22, pulp web 21 is delivered from wire 24 to a plurality of press rolls 27 and then to a conventional dryer section (not shown) of papermaking machine. As pulp web 21 advances in the downstream direction, excess water is permitted to pass through wire 24. A vacuum 28 typically may be applied to at least a portion of the underside of wire 24 to assist in the removal of water from pulp web 21. Vacuum 28 also facilitates the penetration of deposited slurry into pulp web 21. If desired, couch roll 26 may be adapted to provide a vacuum through wire 24 to the underside of pulp web 21 to remove additional water.

The paper produced by the apparatus of the present invention shown in FIGS. 1–5 can then be used to wrap around tobacco material so as to form continuous rods of smoking article material. The continuous rods can then be periodically severed so as to form individual smoking articles that have modified burn rate characteristics.

Figure 6:
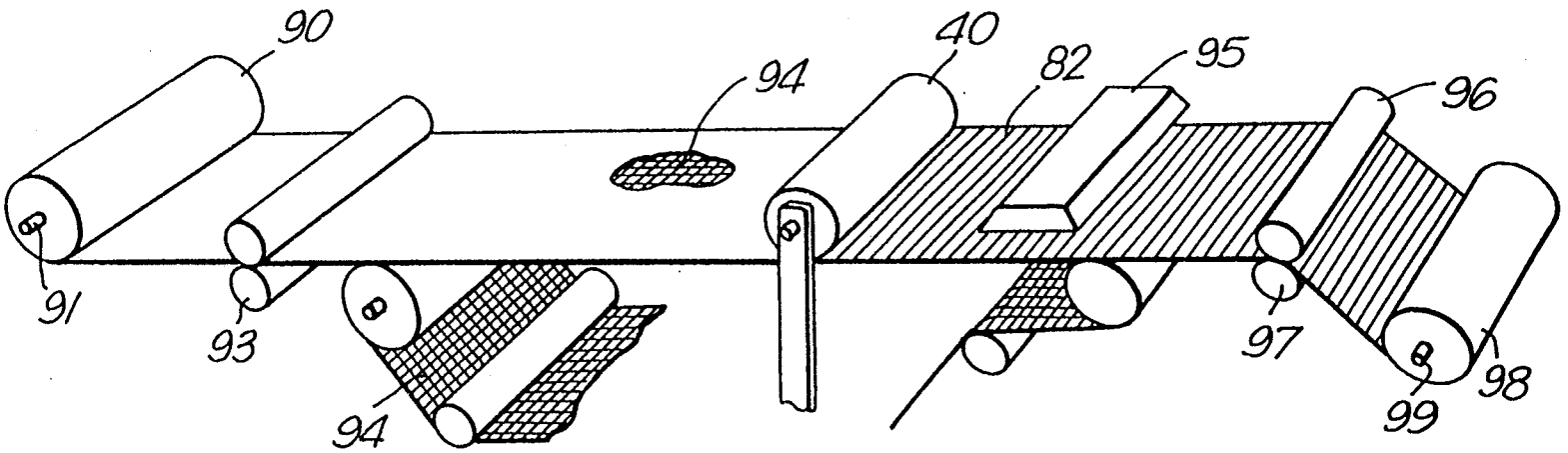
FIG. 6 is a perspective view of a second preferred embodiment of the present invention.

In a second preferred embodiment of the invention, shown in FIG. 6, applicator 40 has been incorporated in a machine to modify premanufactured paper (in a configuration commonly referred to as "off-line", as opposed to the "on-line" configuration shown in FIG. 1). The machine has a roll of premanufactured paper 90 mounted on feedshaft 91. The paper on roll 90 is fed between upper idler 92 and lower idler 93 and onto a continuous moving web 94. A continuous moving web may not be needed, depending on paper strength. For example, the paper may be supported by a shoe (not shown) familiar to those skilled in the art. Applicator 40 is mounted above the continuous moving web 94 which is supporting the paper 90 to be treated.

After the application pattern 82 has been applied to paper 90 by applicator 40, the paper moves underneath dryer 95. A number of types of dryers means familiar to those skilled in the art including felt absorption, heated drums and infrared drying may be used. After the application pattern 82 has been dried by dryer 95, the paper moves between final upper idler 96 and final lower idler 97. Paper 90 is then taken up by take-up roll 98 mounted on take-up shaft 99.

Although the embodiment of the present invention shown in FIG. 6 includes premanufactured paper 90 mounted on feedshaft 91, it will be apparent that premanufactured paper 90, in the alternative, could be supplied on-line directly from a paper making apparatus.

Additionally, although the above embodiments have been discussed with reference to slurry coater 46 wherein slurry (e.g., cellulosic pulp) is applied to the surface of screen roller 60, it will be apparent that other fluidized materials could also be used with coater 46. For example, coater 46 could apply the types of fibrous cellulose which are described in copending, commonly-assigned U.S. Pat. application Ser. No. 07/757,243, filed Sep. 10, 1991, now U.S. Pat. No. 5,263,999 which is hereby incorporated by reference in its entirety. Any other type of material that can be coated onto an underlying paper web could also be used with coater 46.

Furthermore, although the above embodiments have been discussed with reference to banded smoking article wrappers, it will be apparent that many other paper characteristics can be achieved with the present invention. For example, materials that confer distinctive characteristics upon paper, such as (1) inks, (2) dyes, (3) adhesives or (4) compounds which are detectable by electromagnetic means, could also be applied in accordance with the invention.

Additionally, the present invention could also be used to apply a pattern of tobacco flavor material, or a pattern of electrically conductive, resistive or insulating material, for use in electrical smoking flavor generating articles such as those disclosed in commonly-assigned U.S. Pat. No. 5,060,671. In addition, the invention could be used to treat substrates other than paper. Although the preferred embodiments discussed above relate to smoking article paper, it will be apparent that the invention has many applications.

Thus it is seen that an apparatus and method for modifying paper in repetitive patterns where the repetitive patterns are made either on-line or off-line of a paper making apparatus. One skilled in the art will appreciate that the present invention can be practiced by other than the described embodiments, which are presented for purposes of illustration and not of limitation, and the present invention is limited only by the claims that follow.

What is claimed is:

1. A method of applying a fluidized material to a substrate to alter burn rate characteristics of the substrate, said method comprising the steps of:

providing said substrate, said substrate comprising a continuous web comprising paper;

providing said fluidized material, sad fluidized material comprising a slurry for altering burn rate characteristics of said paper web;

moving said substrate along a path;

providing a cylindrical surface having alternating regions of mesh material separated by regions of solid material and having an axis of rotation extending generally across said path, said surface being disposed generally tangent to said path;

applying the fluidized material to said cylindrical surface;

providing a vacuum on an underside of said mesh material so as to allow said fluidized material to adhere to said alternating regions of mesh material;

rotating said cylindrical surface so that the adhered fluidized material is positioned adjacent said substrate; and providing pressure on the underside of said means material to release said adhered fluidized material from said mesh material, whereby said released fluidized material attaches to said substrate.

2. The method of claim 1, further including the step of cleaning the mesh material after the adhered fluidized material releases from the mesh material and before additional fluidized material is applied to the cylindrical surface.

3. The method of claim 1 wherein said continuous web is moved at a speed substantially synchronzied with the rotation of said cylindrical surface.

4. The method of claim 1 wherein said slurry is a cellulosic slurry.

5. The method of claim 1, wherein said regions of mesh material are substantially rectangular and have a width in the range from about 2 mm to about 8 mm.

6. The method of claim 1, wherein said regions of solid material are substantially rectangular and have a width in the range from about 12 mm to about 20 mm so that said alternating regions of mesh material are separated by a distance in the range from about 12 mm to about 20 mm.

7. The method of claim 1, wherein said continuous web is a web of pulp.

8. The method of claim 1, wherein said continuous web comprises a roll of premanufactured paper.

9. An apparatus for applying a fluidized material to a substrate, said apparatus comprising:

a stationary inner valve having a surface that is substantially cylindrical, wherein said surface has a first region defining a first cavity and a second region defining a second cavity, wherein the second cavity is adapted for placement in a region adjacent the substrate;

a vacuum port for supplying vacuum to said first cavity;

a pressure port for supplying pressure to said second cavity;

a cylindrical rotating applicator having an inner surface and an outer surface, said inner surface adapted for making rotational contact with the surface of the stationary inner valve, wherein said applicator has a plurality of spaced channels between the inner surface and the outer surface for providing air flow communication therebetween, said outer surface having regions of mesh material covering said channels to form alternating regions of mesh material and regions of solid material; and a coater for applying the fluidized material to the outer surface of the rotating applicator, said coater positioned in a region adjacent said first cavity so that the vacuum is capable of adhering the applied fluidized material to the mesh material; wherein:

as the rotating applicator rotates, fluidized material is (1) applied to the mesh material by the coater, (2) held in place by way of the vacuum, and (3) rotated into a region adjacent the second cavity so that the pressure communicated through said spaced channels causes the fluidized material to release from the mesh material and deposit onto the substrate.

10. The apparatus of claim 9, further including a cleaner for cleaning the mesh material after the adhered fluidized material releases from the mesh material and before additional fluidized material is applied to the cylindrical surface.

11. The apparatus of claim 9, wherein said substrate comprises a continuous web.

12. The apparatus of claim 9, wherein said substrate is moved at a speed substantially synchronzied with the rotation of said cylindrical applicator.

13. The apparatus claim 11, wherein said continuous web comprises paper.

14. The apparatus of claim 13, wherein said fluidized material comprises a slurry for altering burn rate characteristics of said paper web.

15. The apparatus claim 11, wherein said slurry is a cellulosic slurry.

16. The apparatus of claim 9, wherein said regions of mesh material are substantially rectangular and have a width in the range from about 2 mm to about 8 mm.

17. The apparatus of claim 16, wherein said regions of solid material are substantially rectangular and have a width in the range from about 12 mm to about 20 mm so that said alternating regions of mesh material are separated by a distance in the range from about 12 mm to about 20 mm.

18. The apparatus of claim 11, wherein said continuous web is a web of pulp.

19. The apparatus of claim 11, wherein said continuous web comprises a roll of premanufactured paper.

20. A method of applying a cellulosic slurry to smoking article paper for modifying the burn rate characteristics of a smoking article, said method comprising the steps of:

(a) moving said paper along a path;

(b) providing a cylindrical surface having alternating regions of mesh material separated by regions of solid material and having an axis of rotation extending generally across said path, said surface being disposed generally tangent to said path;

(c) applying cellulosic slurry to said cylindrical surface;

(d) providing a vacuum on an underside of said mesh material so as to allow said cellulosic slurry to adhere to said alternating regions of mesh material;

(e) rotating said cylindrical surface so that the adhered cellulosic slurry is positioned adjacent said paper; and (f) providing pressure on the underside of said mesh material to release said adhered cellulosic slurry from said mesh material, wherein said released cellulosic slurry attaches to said paper.

21. The method of claim 20, further including the step of cleaning the mesh material after the adhered cellulosic slurry releases from the mesh material and before additional cellulosic slurry is applied to the cylindrical surface.

22. The method of claim 20, wherein said paper comprises a continuous web.

23. The method of claim 20, wherein said paper is moved at a speed substantially synchronized with the rotation of said cylindrical surface.

24. The method of claim 20, wherein said regions of mesh material are substantially rectangular and have a width in the range from about 2 mm to about 8 mm.

25. The method of claim 24, wherein said regions of solid material are substantially rectangular and have a width in the range from about 12 mm to about 20 mm so that said alternating regions of mesh material are separated by a distance in the range from about 12 mm to about 20 mm.

26. The method of claim 22, wherein said continuous web is a web of pulp

27. The method of claim 22, wherein said continuous web comprises a roll of premanufactured paper.

28. An apparatus for applying a cellulosic slurry to smoking article paper for modifying burn rate characteristics of a smoking article, said apparatus comprising:

a stationary inner valve having a surface that is substantially cylindrical, wherein said surface has a first region defining a first cavity and a second region defining a second cavity, wherein the second cavity is adapted for placement in a region adjacent the paper;

a vacuum port for supplying vacuum to said first cavity;

a pressure port for supplying pressure to said second cavity;

a cylindrical rotating applicator having an inner surface and an outer surface, said inner surface adapted for making rotational contact with the surface of the stationary inner valve, wherein said applicator has a plurality of spaced channels between the inner surface and the outer surface for providing air flow communication therebetween, said outer surface having regions of mesh material covering said channels to form alternating regions of mesh material and regions of solid material; and a coater for applying the cellulosic slurry to the outer surface of the rotating applicator, said coater positioned in a region adjacent said first cavity so that the vacuum is capable of adhering the applied cellulosic slurry to the mesh material;

wherein:

as the rotating applicator rotates, cellulosic slurry is (1) applied to the mesh material by the coater, (2) held in place by way of the vacuum, and (3) rotated into a region adjacent the second cavity so that the pressure communicated through said spaced channels causes the cellulosic slurry to release from the mesh material and deposit onto the paper.

29. The apparatus of claim 31, further including a cleaner positioned to act on the mesh material for cleaning the mesh material after the adhered cellulosic slurry releases from the mesh material and before additional cellulosic slurry is applied to the cylindrical surface.

30. The apparatus of claim 28, wherein sad paper comprises a continuous web.

31. The apparatus of claim 28, wherein said paper is moved at a speed substantially synchronized with the rotation of said cylindrical applicator.

32. The apparatus of claim 28, wherein said regions of mesh material are substantially rectangular and have a width in the range from about 2 mm to about 8 mm.

33. The apparatus of claim 32, wherein said regions of solid material are substantially rectangular and have a width in the range from about 12 mm to about 20 mm so that said alternating regions of mesh material are separated by a distance in the range from about 12 mm to about 20 mm.

34. The apparatus of claim 30, wherein said continuous web is a web of pulp.

35. The apparatus of claim 30, wherein said continuous web comprises a roll of premanufactured paper.

36. A method for making smoking article wrappers, said method comprising the steps of:

(a) moving a continuous web of paper along a path;

(b) providing a cylindrical surface having an axis of rotation extending generally across said path and having alternating regions of mesh material separated by regions of solid material, said surface disposed generally tangent to said path;

(c) applying cellulosic slurry to said cylindrical surface;

(d) providing a vacuum on an underside of said mesh material so as to allow said cellulosic slurry to adhere to said alternating regions of mesh material;

(e) rotating said cylindrical surface so that the adhered cellulosic slurry is positioned adjacent said paper;

(f) providing pressure on the underside of said mesh material to release said adhered cellulosic slurry from said mesh material, wherein said released cellulosic slurry attaches to said paper;

(g) drying said paper; and (h) severing said continuous web of paper so as to form individual smoking article wrappers.

37. A method for making smoking articles, said method comprising the steps of:

(a) moving a continuous web of paper along a path;

(b) providing a cylindrical surface having alternating regions of mesh material separated by regions of solid material;

(c) applying cellulosic slurry to said cylindrical surface;

(d) providing a vacuum on an underside of said mesh material so as to allow said cellulosic slurry to adhere to said alternating regions of mesh material;

(e) rotating said cylindrical surface so that the adhered cellulosic slurry is positioned adjacent said paper;

(f) providing pressure on the underside of said mesh material to release said adhered cellulosic slurry from said mesh material, wherein said released cellulosic slurry attaches to said paper;

(g) drying said paper;

(h) wrapping said paper around tobacco material so as to form a continuous rod of smoking article material; and (i) severing said continuous rod of smoking article material so as to form individual smoking articles.

* * * * *